US006598323B1

(12) United States Patent
Gougelet et al.

(10) Patent No.: US 6,598,323 B1
(45) **Date of Patent: *Jul. 29, 2003**

(54) TOE PROTECTORS

(76) Inventors: Robert M. Gougelet, 3 Pingree Rd., Hanover, NH (US) 03755; Miguel A. Gonzalez, 3238 S. Newland St., Denver, CO (US) 80227

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/205,674

(22) Filed: Dec. 4, 1998

Related U.S. Application Data

(60) Provisional application No. 60/067,555, filed on Dec. 5, 1997.

(51) Int. Cl.[7] ..... A43C 13/14

(52) U.S. Cl. ..... 36/77 R; 36/77 M

(58) Field of Search ..... 36/77 R, 77 M, 36/72 R

(56) References Cited

U.S. PATENT DOCUMENTS

| | | | | | |
|---|---|---|---|---|---|
| 3,191,321 | A | * | 6/1965 | Brutting | 36/72 R |
| 3,950,483 | A | * | 4/1976 | Spier | 264/328 |
| 3,974,578 | A | | 8/1976 | Oettinger et al. | |
| 3,995,382 | A | | 12/1976 | Smith | |
| 4,103,438 | A | | 8/1978 | Fron | |
| 4,231,170 | A | | 11/1980 | Griswold | |
| 4,257,177 | A | | 3/1981 | Unsted | |
| 4,451,425 | A | * | 5/1984 | Meyer | 64/300 |
| 4,524,043 | A | * | 6/1985 | McDougal | 264/320 |
| 4,530,941 | A | * | 7/1985 | Turner et al. | 264/51 |
| 4,555,551 | A | * | 11/1985 | Makhlouf et al. | 264/328.4 |
| 4,575,953 | A | | 3/1986 | Hetzel | |
| 4,735,003 | A | * | 4/1988 | Dykeman | 36/77 R |
| 4,825,563 | A | | 5/1989 | Strongwater | |
| 4,862,606 | A | * | 9/1989 | Siskind et al. | 36/77 M |
| 4,870,762 | A | | 10/1989 | Lee | |
| 4,908,963 | A | | 3/1990 | Krajcir | |
| 4,910,279 | A | * | 3/1990 | Gillis et al. | 264/324.1 |
| 4,935,178 | A | * | 6/1990 | Esposito et al. | 264/56 |
| 5,056,240 | A | * | 10/1991 | Sherrill | 36/72 R |
| 5,074,060 | A | | 12/1991 | Brncick et al. | |
| 5,210,963 | A | * | 5/1993 | Harwood | 36/77 M |
| 5,331,751 | A | * | 7/1994 | Harwood | 36/77 M |
| 5,666,745 | A | * | 9/1997 | Harwood | 36/77 R |
| 5,809,666 | A | * | 9/1998 | Harwood | 36/77 R |

* cited by examiner

*Primary Examiner*—M. D. Patterson
(74) *Attorney, Agent, or Firm*—Deborah A. Peacock; Jeffrey D. Myers; Andrea L. Mays

(57) ABSTRACT

A thin, non-metallic toe protector comprising short particles and method of making same. The particles are preferably less than 0.25 inches long. The preferred toe cap has a thickness of preferably less than 0.165 inches and a reinforcing matrix. The toe protector meets or exceeds national safety standards.

20 Claims, 2 Drawing Sheets

TOE PROTECTORS

CROSS-REFERENCE TO RELATED APPLICATIONS

This application claims the benefit of the filing of U.S. Provisional Patent Application Serial No. 60/067,555, entitled Toe Caps, filed on Dec. 5, 1997, and the specification thereof is incorporated herein by reference.

BACKGROUND OF THE INVENTION

1. Field of the Invention (Technical Field)

The present invention relates to toe protectors and their composition and manufacturing process.

2. Background Art

Toe caps have served for foot protection in many different areas, from industry to sports to public safety. In the past, the field was dominated by metal or steel toe caps. This type of toe cap is illustrated by the following patents: U.S. Pat. No. 4,908,963, to Krajcir, et al, entitled "Safety Shoe"; U.S. Pat. No. 4,257,177, to Unsted, entitled "Safety Footwear"; U.S. Pat. No. 4,870,762, to Lee, entitled "Safety Shoe Structure"; U.S. Pat. No. 4,231,170, to Griswold, entitled "Instep Protector for Safety Shoes"; U.S. Pat. No. 4,575,953, to Hetzel, entitled "Safety Shoe with Toe Protecting Cap"; and U.S. Pat. No. 3,995,382, to Smith, entitled "Instep Guard for Safety Shoes." While resistant to most forces, steel toe caps have the disadvantage of compressing under extreme pressure, and retaining the compressed shape after the force is removed. This can result in pinching or trapping the foot. In addition to the compression problem, steel toe caps have the added disadvantage of being thermally and electrically conductive, and respond to electromagnetic signals, making steel an unsuitable material for applications in certain fields such as the utility industries. These shortcomings led to the development of use of other, non-metallic compounds to make toe caps.

Numerous patents issued encompassing a variety of shapes and constructs of protective non-metallic footwear. These include U.S. Pat. No. 4,908,963, to Krajcir et al., (flexible metatarsal guard made of plastic, disposed above a steel toe); U.S. Pat. No. 5,074,060, to Brncick (molded semi-rigid plastic toe protector removably attached to shoe); U.S. Pat. No. 4,825,563, to Strongwater (wrap-around shoe attachment made of PVC, cloth, leather or vinyl); U.S. Pat. No. 4,231,170, to Griswold, (instep protector); U.S. Pat. No. 4,103,438, to Fron, (toe/instep protection made of thick polycarbonate in the shape of a clog); and U.S. Pat. No. 3,974,578, to Oettinger, et al, (elastomer cup on tip of tennis shoe).

The prior art does not provide the degree of protection required in many industrial settings. In order to reach full industrial applicability, toe protectors need to meet the minimum testing requirements set by the various safety associations (e.g., American national Standards Institute—ANSI; Occupational Safety and Health Administration—OSHA; Mine Safety and Health Administration—MSHA; and Canadian Standards Association). These tests include both compression and impact studies, and are very rigorous. The ANSI compression test consists of exerting 50 pounds per second (222.4 N) after a load of 500 pounds (2224 N) is reached. The tested specimens are ranked according to the level above this force the specimen can withstand. There are three levels of classifications based upon testing stringency: 1000 pounds, 1750 pounds, and 2500 pounds of compression. Likewise, the ANSI impact resistance test consists of measuring the distance at the moment of maximum deflection at varying forces. The clearance must be at least 16/32 of an inch. If this clearance is maintained at deflection forces ranging form 30–75 foot-pounds, the protective footwear is said to pass. The three levels of classification for impact resistance are 30 foot-pounds, 50 foot-pounds, and 75 foot-pounds.

It has been a goal of the industry, therefore, to design a toe cap that would meet these strict safety requirements, yet still be comfortable, lightweight, and fit various shoe styles. As a result, those in the field turned to the use of polymeric compounds and other synthetics. Dykeman (U.S. Pat. No. 4,735,003) describes a toe protector made of plastic plus fibers of glass, carbon or Kevlar. Siskind (U.S. Pat. No. 4,862,606) describes a fiber-reinforced polymeric compound. The patents of Harwood (U.S. Pat. Nos. 5,210,963, and 5,331,751) disclose long synthetic fibers composed of materials such as polyurethane. Harwood (U.S. Pat. No. 5,809,666) describes a plastic toe cap of minimum thickness of 0.17 inches, and Harwood (U.S. Pat. No. 5,666,745) describes thickness at non-impact points. Several patents describe various constructs to attempt to distribute crushing impact force. These include longitudinal grooves to shift the fracture point (Dykeman), and horizontal slots in the front wall of substantially reduced cross-section for a controlled vertical collapse (Harwood). However, the toe protectors in the field use long fibers (Dykeman,—fiber length of ½ to 2 inches; Harwood,—fiber length of ¼ to one inch) in specific linear alignments. This structure requires a specific gating position and size during the manufacturing process.

The present invention utilizes short fibers or particles and a unique structure to eliminate the need for precise gating positioning, thus reducing the cost of manufacture. The short fibers also result in more consistency throughout the toe protector, and increase strength and flexibility while yielding a thinner, more comfortable device.

SUMMARY OF THE INVENTION (DISCLOSURE OF THE INVENTION)

The present invention is directed to toe protectors, comprising short particles less than approximately 0.25 inches long and a binder. The particles are preferably non-metallic materials. In a preferred embodiment, the particles comprise fibers, and are preferably randomly arranged. In the preferred embodiment, the particles comprise graphite. In an alternative embodiment, the particles comprise glass. In yet another embodiment, the particles comprise polyparaphenylene terephthalamide. The particles may also comprise at least one of the following: polycarbonates, nylons, and ceramics.

In the preferred embodiment, the binder is a resin, such as polyurethane, polyvinylchloride, a mix of styrene, acrylonitrile and nitrile rubber, polycarbonates, nylon, polyethylene, polyethylene terephthalate, polypropylene, polyphenylene sulfide, polyetheretherketone, polyetheramide, polyamides, phenolics, polyesters, epoxies, polyacrylics, or light beam and electron beam curing materials.

The preferred particle content is between approximately 30% and 99% by weight. The preferred binder content is between approximately 1% and 70% by weight, and most preferably between approximately between 1% and 30% by weight. The invention may further comprise an impact modifier, preferably a composite rubber, and more preferably an ethylene propylene diene monomer.

The invention is also directed to toe protectors, comprising a top, a front end, and open back end and sides contiguous with the top and front, and a reinforcing matrix. The matrix preferably comprises ribs, which are horizontally and/or vertically arranged across the top and down the sides. The matrix may comprise zig-zag members. The matrix alternatively comprises at least one of the following configurations: ribs, striations, preferential thickening, and geometric shapes.

The thickness of the toe protector of the present invention is preferably less than approximately 0.165 inches at the matrix. The toe protector thickness at the non-matrix areas is preferably less than 0.135 inches.

The present invention additionally comprises a method of constructing toe protectors by providing a substance (preferably a non-metallic substance) comprising short particles less than 0.25 inches long in a composite material and a binder, and injecting the substance into a mold through a gate. In the preferred embodiment, injecting comprises injecting at a temperature between 300–600 degrees Fahrenheit and at a pressure between 10,000–25,000 psi. The gate may be a randomly-placed gate.

The toe protector of the present invention meets ANSI compression and impact resistance safety standards. A preferred embodiment of the toe protector meets ANSI compression standards of at least 1000 pounds, more preferably 1750 pounds, and most preferably 2500 pounds. A preferred embodiment of the present invention meets ANSI impact resistance standards where the standards comprise clearance of at least 16/32 of an inch within the protector at a minimum of 30 foot-pounds., more preferably 50 foot-pounds, and most preferably 75 foot-pounds.

A primary object of the present invention is to construct a toe protector that meets or exceeds national safety requirements.

Another object of the present invention is to construct a thin toe protector by utilizing short fibers or particulates.

Another object of the present invention is to reduce manufacturing cost in toe protector production by using short fibers and a three-dimensional matrix.

Another object of the present invention is to provide a stronger protective toe protector with reinforcing structures.

Another object of the present invention is to provide a toe protector that will replace the Series 500 Toe Cap within the marketplace.

A primary advantage of the present invention is to utilize short fibers in the composition, thus making gating position during manufacture less critical, and thereby reducing waste and manufacturing costs.

Another advantage of the present invention is to reduce the maximum thickness and weight of the toe protector without sacrificing strength.

Another advantage of the present invention is to combine several composite materials with glass particulates to increase strength of the toe protector.

Another advantage of the present invention is to provide reinforcing matrix within the toe protector.

Another advantage of the present invention is to provide toe protectors that give additional electrical protection in clean rooms.

Another advantage of the present invention is to create a manufacturing process for producing toe protectors that can yield customized toe protectors for a particular industrial use.

Another advantage of the present invention is to create a manufacturing process that lends itself readily to mass production of toe protectors.

Another advantage of the present invention is to produce a toe protector that can be used inside or outside the footwear, or can be incorporated within the footwear.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
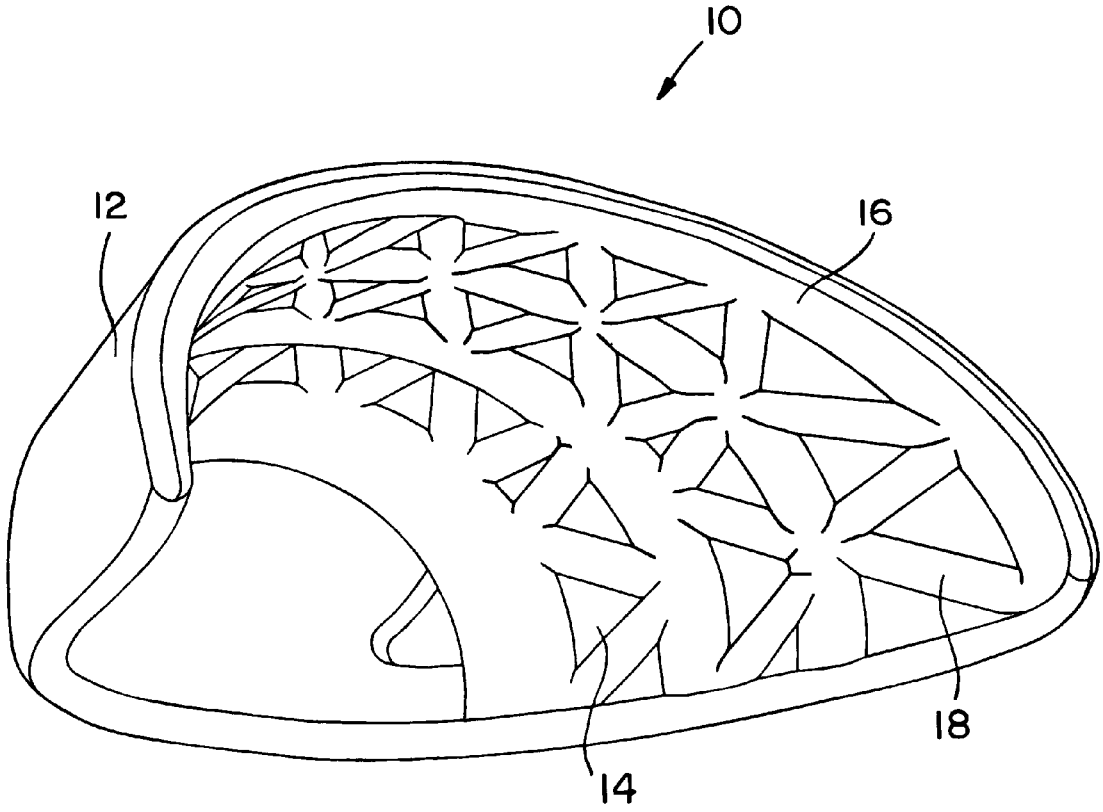
FIG. 1 is a side view of a preferred embodiment of the present invention.

DESCRIPTION OF THE PREFERRED EMBODIMENTS (BEST MODES FOR CARRYING OUT THE INVENTION)

The invention is a toe protector having a minimal thickness that meets or exceeds ANSI and OSHA safety standards for protective footwear. The toe protector is constructed to fit within a standard safety shoe. The toe protector has a preferred thickness of less than 0.165 inches with a preferred range of 0.100–0.250 inches, and a most preferred range of 0.100–0.165 inches. The preferred thickness of the toe protector at non-impact areas in between reinforcement matrix structures is approximately 0.135 inches. At the toe end, the thickness may be up to 0.250 inches, and at the open end, the thickness ranges from 0.143–0.200 inches. The varying thickness within the same protector increase strength at high impact points, while decreasing composition weight and cost. As used throughout the specification and claims, the term "particles" means fibers, particulates, beads, and particles.

The invention maintains strength of structure even with its thinness due to the use of short fibers or other composite materials. Fibers and particles can be of compounds comprising polycarbonates, metals, impacted modified nylons, glass, graphite, ceramics, or Kevlar® (oriented long molecular chains of polyparaphenylene terephthalene, manufactured by DuPont), and the like. These can also be used in various combinations, e.g. Kevlar plus carbon or graphite, Kevlar plus glass, glass plus graphite, or Kevlar plus glass plus graphite. Use of graphite within the composition increases strength, and reduces size and weight of the toe cap. Kevlar increases temperature stability, increases fatigue and fragmentation resistance, dampens vibrations, dispenses shock, and is non-conductive. Glass particulates, such as beads or spheres, add support to the overall structure. The fibers or particles can be used alone or in combination with other substances to customize the toe protector for particular industrial uses. This protector composition provides added chemical resistance.

The fibers used in the invention are preferably less than approximately 0.25 inches long. This is a departure from the prior art toe caps, which used long fibers specially oriented to obtain strength. The short fibers of the present invention may be of variable length under 0.25 inches within the same toe protector, thus reducing waste and manufacturing cost.

Other substances that may be included in the toe protector composition include plastics or resins such as polyurethane, polyvinylchloride (PVC), ABS (polymerized mixture of styrene, acrylonitrile, and nitrile rubber), polycarbonates, polyethylene, polyethylene terephthalate, polypropylene, (including compacted polypropylenes) polyphenylene sulfide, polyetheretherketone, polyetheramide, polyamides, phenolics, polyesters, epoxies, polyacrylics, light beam and electron beam curing materials, and the like. The use of resin systems results in a more elastic toe cap that is capable of returning to its original position after impact, thus reducing injury and allowing for faster shoe removal. A preferred embodiment of the invention comprises fiber and 1–30% plastic/resin. The composition can vary widely, e.g. ranging from 99% fiber plus 1% plastic/resin, to 30% fiber plus 70% plastic/resin. Recycled materials may be used to reduce manufacturing costs.

It is also possible to add ballistics materials, and is easy to modify bonding, adhesives, and degrees of chemical and electrical protection. This allows for different manufacturing techniques such as greater temperatures for gluing and attachment, adding additional spacing structures, sewing holes, and adding additional units to the protector itself such as midsole support.

A variety of techniques can be used to manufacture the invention. A preferred technique is that of basic injection molding. One improvement in manufacturing toe protectors using this technique is the elimination of precise gating position. Inventions in the field require a specific gate size at the open end of the toe cap to properly align the long fibers. The present invention manufacturing process can be gated anywhere, but a preferred embodiment is gated at the front of the toe on the inside of the protector. This is due to the use of short fibers—because the fibers are not long, there is no need for fiber alignment for strength. The process creates uniform distribution of fibers, which results in uniform strength throughout the toe protector. A preferred embodiment of the invention utilizes injection molding at 300–600° F. and at a pressure of 10,000–25,000 psi. Different materials may call for a deviation in these values.

Other manufacturing techniques that can be used include thermoplastic preferential molding, light beam curing, $e^-$ beam (electron beam) curing, thermosetting, compression molding, compacted polypropylenes, and resin transfer techniques.

A preferred embodiment of the toe protector includes a three-dimensional matrix to increase strength. The preferred matrix is horizontal and vertical ribs. Other examples of forms for the matrix include striations, preferential thickening (especially at the toe end (e.g. up to 0.25 inches), or any geometric designs (e.g. spheres, hexagons) on the underside or top surface of the toe cap. The additional structural support provided by the matrix allows for a greater variety of materials and manufacturing processes for the toe protector.

Figure 2:
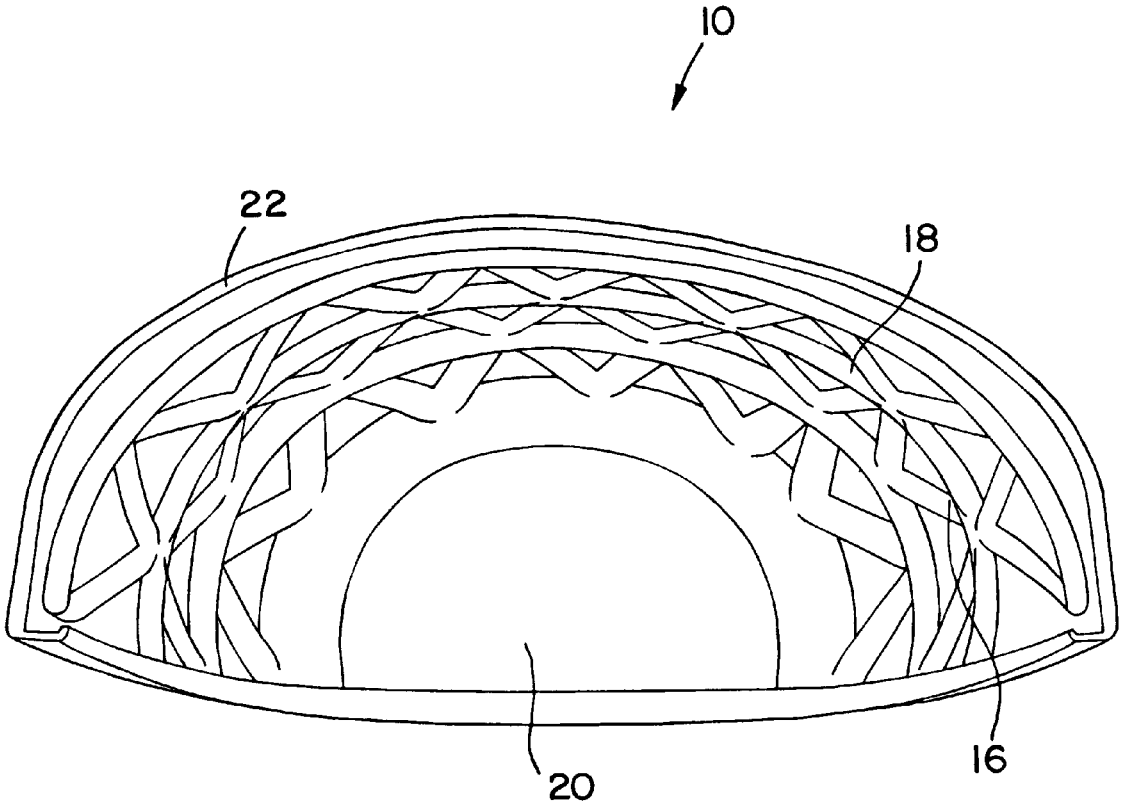
FIG. 2 is an end view of a preferred embodiment of the present invention showing the reinforcement matrix.

FIGS. 1–2 illustrate a preferred embodiment of invention (10). FIG. 1 is a side view of a preferred embodiment of toe protector (10). In toe protector (10), outside (12) is smooth and inside (14) is composed of a reinforcing matrix of ribs (16) and zig-zag members (18). FIG. 2 is an end view of the same embodiment of toe protector (10), looking toward toe end (20). Ribs (16) and zig-zag members (18) extend from back edge (22) toward toe end (20).

EXAMPLE

The invention is illustrated by the following non-limiting example:

A preferred embodiment of toe cap was made using standard injection molding techniques with a temperature of 450° F. and a pressure of 15,000 psi. The materials used in the molding process were a combination of nylon 6/6, an impact modifier of ethylene propylene diene monomer, and 5% glass particles (approximately 1/16 inch long). These materials were injected through a 1/8 inch gate placed at the inside of the protector at the toe end. The resulting toe cap passed the standards of ANSI, exceeding the most stringent classifications of 2500 pounds compression resistance and 75 foot pounds impact resistance.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A toe protector comprising:

an outer surface comprising a composite of short particles predominantly less than 0.25 inches long; and an inner surface comprising a composite of short particles predominantly less than 0.25 inches long, said inner surface defining a binder matrix comprising ribs and diagonal cross supports extending between said ribs, said ribs and said cross supports of a thickness of less than 0.165 inches.

2. The toe protector of claim 1 wherein said particles comprise non-metallic materials.

3. The toe protector of claim 1 wherein said particles comprise fibers.

4. The toe protector of claim 3 wherein said composite comprises randomly arranged fibers.

5. The toe protector of claim 1 wherein said particles comprise graphite.

6. The toe protector of claim 1 wherein said particles comprise glass.

7. The toe protector of claim 1 wherein said particles comprise polyparaphenylene terephthalamide.

8. The toe protector of claim 1 wherein said particles comprise at least one member selected from the group consisting of polycarbonates, nylons, and ceramics.

9. The toe protector of claim 1 wherein said binder comprises resin.

10. The toe protector of claim 9 wherein said resin comprises at least one resin selected from the group consisting of polyurethane, polyvinylchloride, styrene, acrylonitrile, nitrile rubber, polycarbonates, nylon, polyethylene, polyethylene terephthalate, polypropylene and compacted polypropylene, polyphenylene sulfide, polyetheretherketone, polyetheramide, polyamides, phenolics, polyesters, epoxies, polyacrylics, light beam curing materials and electron beam curing materials.

11. The toe protector of claim 1 wherein said protector comprises a particle content between approximately 30% and 99% by weight.

12. The toe protector of claim 1 wherein said protector comprises a binder content between approximately 1% and 70% by weight.

13. The toe protector of claim 12 wherein said protector comprises a binder content of approximately between approximately 1% and 30% by weight.

14. The toe protector of claim 1 wherein said outer surface comprises an outer surface of a thickness of approximately 0.135 inches, said outer surface and said matrix for providing an ANSI compression force resistance of at least 1000 pounds.

15. A toe protector comprising:

a top;

a front toe end of said top;

an open back end;

sides contiguous with said top and said front toe end, forming a formed toe protector; and a reinforcing and strengthening matrix comprising a non-metallic composite of short particles predominantly less then 0.25 inches, said matrix forming an interior surface of said top, front toe end, and sides, said matrix further comprising ribs horizontally arranged across said top and down said sides.

16. The toe protector of claim 15 wherein said matrix comprises at least one configuration selected from the group consisting of striations, preferential thickening, and geometric shapes.

17. The toe protector of claim 15 wherein said top of said toe protector comprises a thickness in the range of between 0.100–0.165 inches.

18. A toe protector comprising:

a top;

a front toe end of said top;

an open back end;

sides contiguous with said top and said front toe end, forming a formed toe protector; and a reinforcing and strengthening matrix comprising a non-metallic composite of short particles predominantly less then 0.25 inches, said matrix forming an interior surface of said top, front toe end, and sides, said matrix further comprising ribs vertically arranged across said top and down said sides.

19. The toe protector of claim 18 wherein said matrix comprises at least one configuration selected from the group consisting of striations, preferential thickening, and geometric shapes.

20. The toe protector of claim 18 wherein said top of said toe protector comprises a thickness in the range of between 0.100–0.165 inches.

* * * * *

UNITED STATES PATENT AND TRADEMARK OFFICE

CERTIFICATE OF CORRECTION

PATENT NO. : 6,598,323, B1
DATED : July 29, 2003
INVENTOR(S) : Robert M. Gougelet et al.

It is certified that error appears in the above-identified patent and that said Letters Patent is hereby corrected as shown below:

Title page,
Item [75], Inventors, please add the following deleted inventor's name:
-- Miguel A. Gonzalez --

Signed and Sealed this

Twenty-seventh Day of January, 2004

JON W. DUDAS
*Acting Director of the United States Patent and Trademark Office*